US009366212B2

(12) United States Patent
Breuille-Martin et al.

(10) Patent No.: US 9,366,212 B2
(45) Date of Patent: Jun. 14, 2016

(54) METHOD FOR DIAGNOSING A DRIFT IN AT LEAST ONE INJECTOR OF A COMMON-RAIL FUEL INJECTION SYSTEM

(71) Applicant: RENAULT s.a.s., Boulogne-Billancourt (FR)

(72) Inventors: Franck Breuille-Martin, Intville-la-Guetard (FR); Sylvain Hourlier, Arpajon (FR); Didier Waszak, Longjumeau (FR)

(73) Assignee: RENAULT s.a.s., Boulogne-Billancourt (FR)

( * ) Notice: Subject to any disclaimer, the term of this patent is extended or adjusted under 35 U.S.C. 154(b) by 48 days.

(21) Appl. No.: 14/363,544

(22) PCT Filed: Nov. 9, 2012

(86) PCT No.: PCT/EP2012/072248

§ 371 (c)(1),
(2) Date: Jun. 6, 2014

(87) PCT Pub. No.: WO2013/083352

PCT Pub. Date: Jun. 13, 2013

(65) Prior Publication Data

US 2014/0360470 A1 Dec. 11, 2014

(30) Foreign Application Priority Data

Dec. 6, 2011 (FR) ..... 11 61218

(51) Int. Cl.
*F02D 41/00* (2006.01)
*F02M 65/00* (2006.01)
(Continued)

(52) U.S. Cl.
CPC ..... *F02M 65/00* (2013.01); *F02D 41/008* (2013.01); *F02D 41/221* (2013.01);
(Continued)

(58) Field of Classification Search
CPC ..... F02M 65/001; F02D 41/008; F02D 200/0602; F02D 2041/2242
USPC ..... 123/458, 479, 673; 73/114.43, 114.51
See application file for complete search history.

(56) References Cited

U.S. PATENT DOCUMENTS 5,131,371 A * 7/1992 Wahl ..... F02D 41/0085 123/436
5,548,514 A * 8/1996 Hasegawa ..... F01L 1/267 123/479

(Continued)

FOREIGN PATENT DOCUMENTS

DE 199 08 352 A1 8/2000
DE 101 55 252 A1 5/2003

(Continued)

OTHER PUBLICATIONS

Search Report issued Aug. 21, 2012 in French Patent Application No. FR 1161218 FA 761043 (with English translation of Category of Cited Documents).

(Continued)

*Primary Examiner* — Erick Solis
(74) *Attorney, Agent, or Firm* — Oblon, McClelland, Maier & Neustadt, L.L.P

(57) ABSTRACT

A method of diagnosis of a drift of at least one injector of an injection system with a common ramp, which includes a pressure regulating control unit and a richness regulating control unit, the pressure and richness regulating control units being driven by an electronic computer according to values of pressure setpoint and of richness setpoint which are recorded in the computer, the method of diagnosis including checking for existence of a drift of the pressure regulating control and checking for existence of a drift of the richness regulating control when the two units operate in closed loop, the drift of the injector being established upon the joint detection of a drift of the pressure regulating control unit and of a drift of the richness regulating control unit.

3 Claims, 2 Drawing Sheets

(51) Int. Cl.
*F02D 41/22* (2006.01)
*F02M 63/02* (2006.01)

(52) U.S. Cl.
CPC ..... *F02M 63/0275* (2013.01); *F02M 65/001* (2013.01); *F02D 2041/224* (2013.01); *F02D 2041/227* (2013.01); *F02D 2041/228* (2013.01); *F02D 2200/0602* (2013.01)

(56) References Cited

U.S. PATENT DOCUMENTS 6,474,292 B1 11/2002 Frenz et al.
7,779,678 B2 * 8/2010 Wolber ..... F02D 41/221 73/114.45
8,103,430 B2 * 1/2012 Aliakbarzadeh .... F02D 41/0085 123/479
9,133,839 B2 * 9/2015 Rampen ..... F04B 7/0076
2006/0266332 A1 * 11/2006 Kloos ..... F02D 41/008 123/446
2008/0009999 A1 * 1/2008 Sugiyama ..... F02D 41/2438 701/103
2008/0264155 A1 10/2008 Achleitner et al.
2011/0160981 A1 6/2011 Rieger et al.
2012/0118053 A1 * 5/2012 Serra ..... F02D 41/221 73/114.51

FOREIGN PATENT DOCUMENTS

DE 10 2004 028 515 B3 11/2005
DE 10 2009 051 023 A1 5/2011
FR 2 846 052 A1 4/2004

OTHER PUBLICATIONS

International Search Report issued Dec. 18, 2012, in PCT/EP2012/072248, filed Nov. 9, 2012.

* cited by examiner

METHOD FOR DIAGNOSING A DRIFT IN AT LEAST ONE INJECTOR OF A COMMON-RAIL FUEL INJECTION SYSTEM

BACKGROUND

The invention relates to the detection of a drift or spread on injectors in relation to reference injectors in a common-rail fuel injection system.

The invention relates more specifically to a method for diagnosing a drift or spread on injectors belonging to a common-rail injection system.

A drift or spread means an abnormal delivery of fuel by at least one of the injectors of the injection system by comparison with a nominal delivery considered.

In present-day internal combustion engines, it has proven necessary and compulsory to fully master the quantities of fuel injected by the injection system in order to guarantee nominal engine operation. What happens is that any drift or spread on the injection of fuel by comparison with a nominal batch may have a significant impact on engine pollutant emissions and performance.

It is therefore essential to be able as soon as possible to detect any potential drift relating to the injectors of an injection system.

American patent application U.S. 2011/0030655 discloses a method that makes it possible to detect an abnormal injector delivery within an injection system. The injection system described in that application has a delivery regulating circuit comprising a delivery regulating value and a pressure regulating circuit. The method consists in detecting injection anomalies in the injection system when, with the delivery regulating circuit operating in closed loop and the pressure regulating circuit operating in open loop, the difference between a minimum throughflow of fuel through the delivery regulating value, which throughflow is established using a predetermined map that is a function of engine speed and the ordained injection quantity, and a throughflow of fuel established by the closed-loop control of the delivery regulating valve, is greater than a predetermined threshold value (K).

The method described in the aforementioned patent application does, however, have a certain number of drawbacks.

In particular, the method described allows a diagnosis to be reached only at certain operating points (stabilized points or specific points).

Moreover, because detection is based on just one single predetermined threshold value, it is necessary to plan for this value to be fairly high. As a result, only significant injector drifts can be detected.

In addition, the closed-loop value may drift as a result of drifts other than that affecting the injectors. Thus, the drift relating to the delivery may be associated with the sensor that measures the pressure of the fuel in the rail, with the high-pressure pump, with the discharge valve or even with any other factor that may cause the rail pressure or the delivery entering the common rail to vary. Now, the method described in the aforementioned application is unable to distinguish an injector drift from a drift caused by other components. In other words, with the method described in the American document, a drift may be observed even though the injectors are not drifting.

BRIEF SUMMARY

The invention seeks to overcome these problems by proposing a diagnostics method that makes it possible, on the one hand early and on the other hand reliably and accurately, to establish a drift in one or more injectors forming part of a common-rail fuel injection system.

Another object of the diagnostics method is to make it possible to characterize the type of drift, namely, in the context of an abnormal injector delivery, to determine whether it is a drift associated with too high a delivery by the injectors or alternatively with too low a delivery by the injectors. A delivery referred to as "too high" or "too low" means a delivery that is respectively above or below the expected nominal fuel delivery.

To this end, and according to a first aspect, the invention proposes a method for diagnosing a drift in at least one fuel injector forming part of a common-rail injection system which system comprises a control unit for the closed-loop pressure regulation of the fuel in the common rail and a control unit for the closed-loop richness regulation of an air/fuel mixture, the control units for regulating pressure and richness being operated by an electronic processor on the basis of a pressure setpoint value and of a richness setpoint value both of which values are predefined and recorded in the processor, the diagnostics method comprising a step of checking for the existence of a drift in the pressure regulating control unit, and a step of checking for the existence of a drift in the richness regulating control unit, the drift in the injector being established as present if a drift in the pressure regulating control unit and a drift in the richness regulating control unit are jointly detected during the checking steps.

Thus, as only the drifting of the injectors causes a drifting of both regulation control units, the joint existence of a drift in the pressure regulating control and of a drift in the richness regulating control provide assurance that at least one of the injectors is drifting.

Advantageously, the drift in the pressure regulating control unit is detected when the pressure regulating control unit applies, in order to reach the pressure setpoint value, a corrective term higher than a threshold discrepancy between a measured fuel pressure value and the predefined ceiling pressure setpoint value or lower than a threshold discrepancy between a measured fuel pressure value and the predefined floor pressure setpoint value.

Advantageously, the drift in the richness regulating control unit is determined i) when the discrepancy in richness recorded between a measured air/fuel mixture richness value and the richness setpoint value or ii) when the richness control unit applies, in order to reach the richness setpoint value, a corrective term higher than a threshold discrepancy between a measured air/fuel mixture richness value and the predefined ceiling richness setpoint value or lower than a threshold discrepancy between a measured air/fuel mixture richness value and the predefined floor richness setpoint value.

Advantageously, it is planned that a drift in the injector is established as present when the recorded pressure discrepancy or the corrective term of the pressure regulating control unit is below the predefined floor threshold and the recorded richness discrepancy or the corrective term of the richness control unit is above the predefined ceiling threshold, or when the recorded pressure discrepancy or the corrective term of the pressure regulating control unit is above the predefined ceiling threshold and the recorded richness discrepancy or the corrective term of the richness control unit is below the predefined floor threshold.

Advantageously, the steps of checking for the existence of a drift in the pressure regulating control unit on the one hand, and for a drift in the richness regulating control unit on the other hand, are performed simultaneously.

Advantageously, the steps of checking for the existence of a drift in the pressure regulating control unit on the one hand and for a drift in the richness regulating control unit on the other hand, are preceded by a step of verifying the closed-loop operation of the pressure regulating control unit and of the richness regulating control unit.

The method according to the invention has the advantage of offering a reliable diagnosis, this diagnosis being consolidated by cross-referencing information (information relating to the pressure regulating control unit and information relating to the richness regulating control unit).

The method according to the invention also has the advantage that, on account of its accuracy, it makes it possible to detect moderate or even small drifts.

It also makes it possible to detect a drift in the injectors as soon as this drift begins. That has the advantage of allowing a drift to be acted upon swiftly, thus preventing any drift from becoming irreversible.

BRIEF DESCRIPTION OF THE DRAWINGS

Other objects and advantages of the invention will become apparent during the following description given with reference to the attached drawings in which.

DETAILED DESCRIPTION

Figure 1:
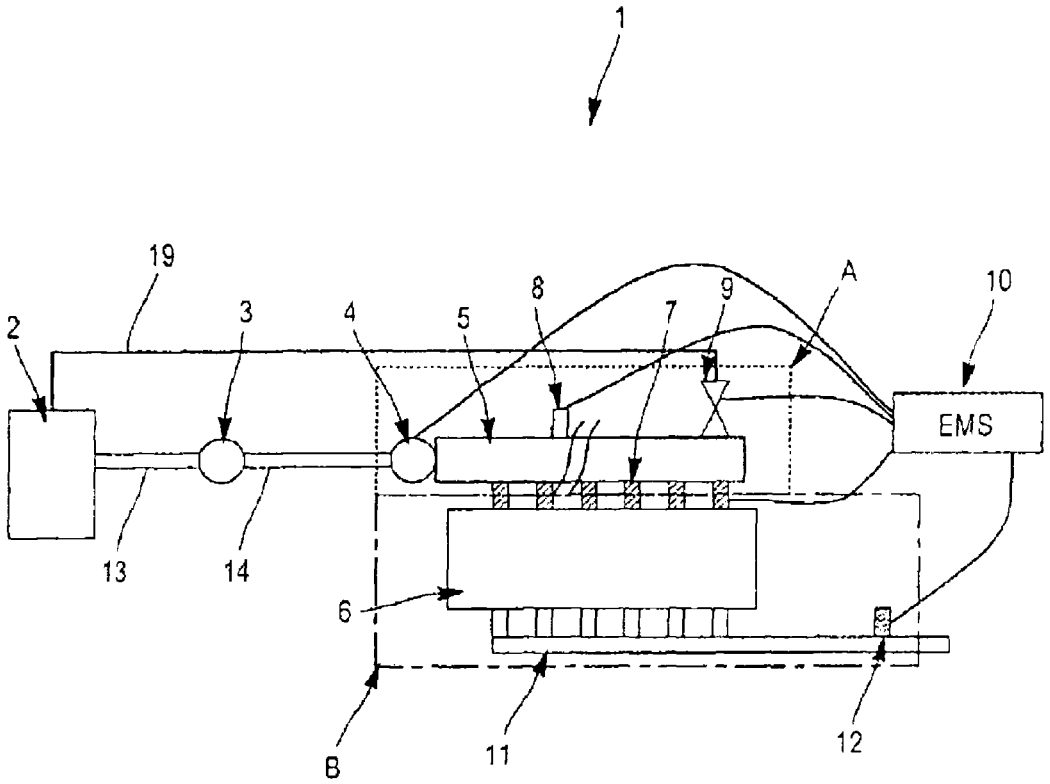
FIG. 1 depicts a schematic view of a common-rail injection system employing the diagnostics method according to the invention.

A common-rail injection system 1 of an internal combustion engine implementing the diagnostics method according to the invention is described in conjunction with FIG. 1.

According to the embodiment illustrated, the common-rail injection system 1 comprises a fuel tank 2, a low-pressure feed pump 3 (also referred to as the supply pump), a high-pressure injection pump 4 (the pressure being of the order of 40 to 2000 bar ($10^5$ Pa) depending on the fuel), a common rail 5 able to accumulate the fuel placed under pressure by the high-pressure pump 4, a plurality of combustion chambers 6 and a plurality of fuel injectors 7 connecting each combustion chamber 6 to the common rail 5.

The low-pressure feed pump 3, connected to the outlet of the storage tank by a first low-pressure pipe 13, carries the fuel from the tank 2 to the high-pressure injection pump 4 along a second low-pressure pipe 14. The fuel, placed under pressure by the high-pressure pump 4, is then accumulated in the common rail 5 to be supplied to each of the fuel injectors and injected under pressure by these injectors into the cylinders of the engine.

In the conventional way, injection is managed by an electronic processor 10 which will determine the injection duration, and therefore the quantity of fuel to be injected, so as to meter the appropriate air/fuel mixture as perfectly as possible in order to obtain optimum engine efficiency.

Thus, in order to keep the fuel inside the common rail 5 at a predefined pressure referred to as the pressure setpoint, the injection system 1 comprises a control unit for closed-loop pressure regulation (A) (also commonly referred to as a "closed-loop pressure regulator", a "closed-loop pressure regulating circuit" or a "pressure regulating loop").

Moreover, internal combustion engines need, in order to comply with emission standards and supply the required engine torque, to operate at a predetermined setpoint richness, namely with a given air/fuel mixture ratio. Hence, in order to maintain an air/fuel mixture that is substantially equal to the predefined richness setpoint value, the injection system also comprises a control unit for the closed-loop richness regulation (B) (also commonly referred to as "closed-loop richness regulator", "closed-loop pressure regulating circuit" or "pressure regulating loop").

Control Unit for Closed-Loop Pressure Regulation (A)

The control unit for closed-loop pressure regulation (A) comprises a pressure sensor 8 arranged with the common rail 5 to determine the pressure of the fuel inside the common rail 5 on the one hand and a reflux circuit that makes it possible to adjust the quantity of fuel accumulated in the rail as a function of the pressure measured by the pressure sensor 8 and of the predefined pressure setpoint value.

The reflux circuit comprises a reflux pipe 19 connecting the common rail 5 to the fuel tank 2 and a discharge valve 9 formed at the inlet to the reflux pipe 19. Thus, when the pressure measured by the pressure sensor 8 is higher than the pressure setpoint value, the discharge valve 9 allows some of the fuel to be discharged to the tank 2 through the reflux pipe 19, thus reducing the pressure in the common rail 5.

Moreover, aside from rapidly discharging fuel from the common rail 5, the discharge valve 9 also allows downward pressure transients to be controlled swiftly in order to prevent the rail pressure regulation from diverging.

The high-pressure pump 4, the pressure sensor 8 and the discharge valve 9 are respectively controlled by the processor 10. More specifically, the processor 10 regulates the pressure contained in the common rail as a function of the pressure setpoint value by operating the high-pressure pump 4 and the discharge valve 9.

Thus, on the basis of the pressure data recorded by the pressure sensor 8 and transmitted to the processor 10, the latter will control the high-pressure pump 4 and the opening or closing of the discharge valve 9 accordingly in order to decrease or increase the volume of fuel expelled into the common rail 5 and thus regulate the pressure maintained in the common rail 5 as a function of the imposed pressure setpoint value level.

The closed-loop pressure regulating control unit therefore has the role, as we have just seen, of ensuring that the fuel rail pressure setpoint (P_rail_spt) is adhered to by using the rail pressure measurement (P_rail_mes) measured by the pressure sensor 8 and controlling the high-pressure pump 4 and the discharge valve 9 accordingly.

The closed-loop control of the high-pressure pump 4 (BF_hp) can be broken down into two parts, namely the open loop (BO_hp) and the regulator (PI), the regulator (PI) being generally made up of a proportional term (P) and of an integral term (I) both of which are dependent on the discrepancy between the fuel rail pressure setpoint (P_rail_spt) and the rail pressure measurement (P_rail_mes).

The P term rapidly and temporarily corrects a large difference, the I term slowly correcting a static error.

Thus, closed-loop control of the high-pressure pump (BF_hp) can be written as follows:

$$BF_hp = BO_hp + PI$$

with (1)

$$PI = P + I,$$

where $$P = p(P_rail_spt - P_rail_mes)$$

$$I = i(P_rail_spt - P_rail_mes)$$

p and i being the transfer functions of the P and I terms (2) the open loop BO_hp is essentially dependent on the mass that is to be made to enter the rail, and that will be referred to as M_hp.

Control Unit for Closed-Loop Richness Regulation (B)

The control unit for closed-loop richness regulation comprises an exhaust line 11 connected to the combustion chamber 6 into which the fuel is injected by the injectors 7. In order to determine the richness or leanness of the air/fuel mixture, the exhaust line 11 is equipped with a richness probe 12.

Like with the data relating to the pressure in the common rail 5, the richness data recorded by the richness probe 12 are intended to be transmitted to the processor 10 so as to be compared against a richness setpoint value that is predefined and recorded in the storage memory of the processor 10. Thus, on the basis of the richness data recorded by the richness probe 12 and received by the processor 10, the latter will control the injection time in such a way as to maintain an air/fuel mixture that has a richness more or less in accordance with the imposed richness setpoint value.

The control unit for closed-loop richness regulation therefore has the role, as we have just seen, of ensuring that the mixture richness setpoint (Ri_spt) is adhered to. There will therefore be measured, via the richness probe 12, the richness in the exhaust line 11 (Ri_mes). The richness of the mixture will be corrected as a function of the richness value measured in the exhaust line 11, using the delta between these two information items.

The setpoint richness is, by definition, defined as follows:

$$Ri_spt=(M_carb*Ks)/M_air \quad (1)$$

where

M_carb is the setpoint mass of fuel to be admitted per cylinder

M_air is the mass of air admitted per cylinder, defined from a model or from a direct or indirect measurement Ks is the stoichiometric coefficient of the fuel used.

Thus, in internal combustion engines, the quantity of fuel to be injected or the setpoint richness, as required, is defined and the other of those data items is deduced. Thus, either M_carb is fixed and Ri_spt is deduced, or Ri_spt is fixed and M_carb is deduced.

M_carb will be used directly to control the injectors using the characteristics thereof and the operating point.

A closed-loop richness regulator (Ri_bf) can therefore be defined as follows: Ri bf=Ri_spt+BF where BF=bf(Ri_spt−Ri_mes), BF being the closed-loop factor and bf being a function which fairly progressively reintroduces the discrepancy between the setpoint and the measurement.

In order to standardize this regulation, CL is defined as follows:

$$CL=Ri_bf/Ri_spt \quad (2)$$

hence $$CL=(Ri_spt+BF)/Ri_spt$$

For engines which, for example, operate by changing the fuel delivery in order to change the torque, by defining the parameter M_air_bf as being the closed-loop mass of air in order to adhere to the closed-loop richness setpoint for the same mass of fuel, it is possible to write:

$$Ri_bf=(M_carb*Ks)/M_air_bf$$

reintroducing (1) and (2) yields:

$$Ri_bf=CL*Ri_spt \text{ from (2)}$$

hence:

$$Ri_bf=CL*(M_carb*Ks)/M_air$$

$$(M_carb*Ks)/M_air_bf=CL*(M_carb*Ks)/M_air$$

hence $$M_air_bf=M_air/CL$$

For engines which, for example, operate by changing the amount of air in order to change the torque, by defining the parameter M_carb_bf as being the closed-loop mass of fuel in order to adhere to the closed-loop setpoint richness for the same mass of air, it is possible to write:

$$Ri_bf=(M_carb_bf*Ks)/M_air$$

reintroducing (1) and (2) yields:

$$Ri_bf=CL*Ri_spt \text{ from (2)}$$

hence $$Ri_bf=CL*(M_carb*Ks)/M_air$$

$$(M_carb_bf*Ks)/M_air=CL*(M_carb*Ks)/M_air$$

hence $$M_carb_bf=M_carb*CL$$

The factor CL will therefore be applied either directly to Mcarb or to M_air depending on the engine and the requirements.

Injector Drift—Diagnostics Method

Failure or non-failure of at least one of the injectors can be diagnosed on the basis of the recorded discrepancies between the values measured respectively by the fuel pressure sensor 8 and by the richness probe and the pressure and richness setpoint values recorded in the processor 10 or on the basis of the corrections made by one or both of these two closed-loop regulating control units or on the basis of one discrepancy and one correction.

The diagnostics method according to the invention is described hereinafter, the steps being indicated in the flow diagram of FIG. 2.

The diagnostics method is implemented when the pressure and richness regulating control units are operating in closed loop. It therefore advantageously comprises prior steps of verifying that the pressure regulating control unit (A) and the richness regulating control unit (B) (blocks 50 and 60) are operating in closed loop. In the embodiment illustrated, the verification steps are performed successively. Thus, first of all, a check is carried out to ensure that the pressure regulating control unit (block 50) is operating in closed loop, and then secondly to ensure that the richness regulating control unit (block 60) is operating in closed loop. It is, of course, obvious that these two verification steps may be performed simultaneously without thereby departing from the scope of the invention.

Once the pressure regulating and richness regulating control units are in operation, the existence of any injector drift can be established. Thus, a drift whereby the injectors have a delivery lower than the nominal (drift hereinafter referred to as K1) and a drift whereby the injectors have a delivery higher than the nominal (drift hereinafter referred to as K2) can be established.

As will be explained later on, these drifts are determined using predefined thresholds regarding the pressure regulation information on the one hand and the richness regulation information on the other. Thus:

for determining the defect K1 there are defined: a pressure correction floor discrepancy threshold II and a richness correction ceiling discrepancy threshold CL1;

for determining the defect K2 there are defined: a pressure correction ceiling discrepancy threshold 12 and a richness correction floor discrepancy threshold CL2.

More specifically, the method comprises a step of checking for the existence of a drift in the pressure regulating control unit, a step of checking for the existence of a drift in the richness regulating control unit, the drift in the injectors being established as being present if a drift in the pressure regulating control unit and a drift in the richness regulating control unit are jointly detected.

The step of checking for the existence of a drift in the pressure regulating control unit consists in comparing the corrective term of the pressure regulating control unit against the predefined floor II and ceiling 12 discrepancy thresholds recorded in the memory of the processor 10. A "corrective term of the regulating control unit" is defined as the sum of the terms of the pressure regulator that allows the latter to check the pressure (in this instance PI).

The drift in the pressure regulating control unit is then established as being present when the corrective term of the pressure regulating control unit is below the floor discrepancy threshold II or above the ceiling discrepancy threshold 12.

Likewise, the step of checking for the existence of a drift in the richness regulation control unit consists in comparing the regulated richness discrepancy or the corrective term of the richness control unit against the predefined floor discrepancy threshold CL2 and ceiling discrepancy threshold CL1 recorded in the memory of the processor 10. A "regulated richness discrepancy" is defined as the discrepancy between the richness value measured by the richness probe 12 and the predefined richness setpoint value recorded in the processor 10. The "corrective term of the richness control unit" is defined as the sum of the terms of the richness regulator that allows the latter to check the richness.

The drift in the richness regulating control unit is then established as being present when the regulated richness discrepancy or the corrective term of the richness control unit is below the floor discrepancy threshold CL2 or above the ceiling discrepancy threshold CL1.

As mentioned, the drift in the injectors is established as being present when a drift both in the pressure regulating control unit and in the richness regulating control unit are detected at once. Specifically, only the drift in the injectors causes a drift in both regulating units. Furthermore, it is possible to characterize the type of injector drift according to the type of drift in the pressure and richness regulating circuits.

Thus, when a drift in the pressure regulating control unit appears such that the corrective term of the pressure regulating control unit is below the floor discrepancy threshold II and a drift in the richness regulating control unit appears such that the regulated richness discrepancy is higher or the corrective term of the richness loop than the ceiling discrepancy threshold CL1, it may be deduced that the injectors are injecting into the combustion chamber 6 a delivery of fuel that is below the expected nominal delivery (which drift is referred to as K1 in the flow diagram illustrated in FIG. 2). Such a drift may for example indicate a fouling of the injectors.

Figure 2:
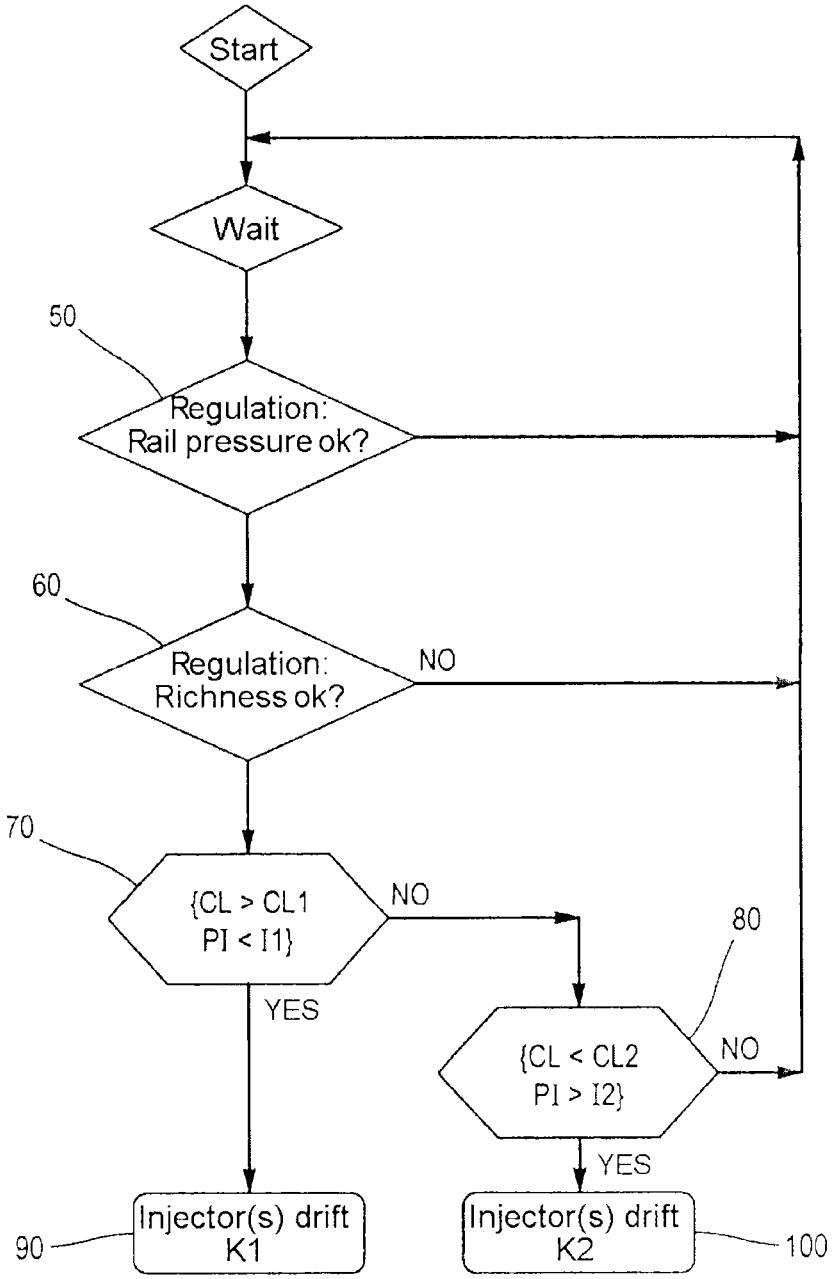
FIG. 2 depicts a flow diagram showing the steps in diagnosing a drift in the injectors of the injection system of FIG. 1.

Likewise, when a drift in the pressure regulating control unit appears such that the corrective term of the pressure regulating control unit is above the ceiling discrepancy threshold 12 and a drift in the richness regulating control unit appears such that the regulated richness discrepancy higher or the corrective term of the richness regulating control unit is lower than the floor discrepancy threshold CL2, it is deduced that the injectors are injecting into the combustion chamber 6 a delivery of fuel that is above the expected nominal delivery (which drift is referred to as K2 in the flow diagram illustrated in FIG. 2).

Thus, if the conditions defined in block 70 are met, the existence of a drift in the injectors is confirmed, this drift relating to the drift K1 (block 90). By contrast, if the conditions defined in block 70 are not met, steps are taken to verify whether the conditions defined in block 80 are met. If they are, the existence of a drift in the injectors is confirmed, this drift relating to the drift K2 (block 100). If not, there is not drift in the injectors and the diagnostics steps described hereinabove are repeated.

In the foregoing, the invention is described by way of example. It must be understood that a person skilled in the art is competent to embody the invention in various ways without thereby departing from the scope of the invention.

The invention claimed is:

1. A method for diagnosing a drift in at least one fuel injector forming part of a common-rail injection system, the system including a control unit for a closed loop pressure regulation of fuel in the common rail and a control unit for a closed loop richness regulation of an air/fuel mixture, the control units for regulating pressure and richness being operated by an electronic processor based on a pressure setpoint value and of a richness setpoint value both of which values are predefined and recorded in the processor, the diagnostics method comprising:

checking for existence of a drift in the pressure regulating control unit, the drift in the pressure regulation control unit being detected when the pressure regulating control unit applies, to reach the pressure setpoint value, a corrective term lower than a threshold discrepancy between a measured fuel pressure value and a predefined floor pressure setpoint value;

checking for existence of a drift in the richness regulating control unit, the drift in the richness regulating control unit being determined when the richness control unit applies, to reach the richness setpoint value, a corrective term higher than a threshold discrepancy between a measured air/fuel mixture richness value and a predefined ceiling richness setpoint value; and establishing the drift in the injector as present when the drift in the pressure regulating control unit and the drift in the richness regulating control unit are jointly detected during the checking operations.

2. The diagnostics method as claimed in claim 1, wherein the checking for the existence of a drift in the pressure regulating control unit and for a drift in the richness regulating control unit are performed simultaneously.

3. The diagnostics method as claimed in claim 1, wherein the checking for the existence of a drift in the pressure regulating control unit and for a drift in the richness regulating control unit are preceded by a verifying the closed loop operation of the pressure regulating control unit and of the richness regulating control unit.

* * * * *